US006652068B2

(12) United States Patent
Hsu et al.

(10) Patent No.: US 6,652,068 B2
(45) Date of Patent: Nov. 25, 2003

(54) COMPACT PRINTHEAD AND METHOD OF DELIVERING INK TO THE PRINTHEAD

(75) Inventors: Tsung-Ping Hsu, Tao-Yuan Hsien (TW); Chih-Ching Chen, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 11 days.

(21) Appl. No.: 10/065,483

(22) Filed: Oct. 23, 2002

(65) Prior Publication Data

US 2003/0085959 A1 May 8, 2003

(30) Foreign Application Priority Data

Nov. 8, 2001 (TW) ..... 90127719 A

(51) Int. Cl.[7] ..... B41J 2/155; B41J 2/21; B41J 2/05

(52) U.S. Cl. ..... 347/42; 347/43; 347/65

(58) Field of Search ..... 347/56, 61, 12, 347/40, 63, 65, 67, 43, 85–87, 42

(56) References Cited

U.S. PATENT DOCUMENTS 5,025,271 A * 6/1991 Baker et al. ..... 347/43
6,267,468 B1 * 7/2001 Torgerson et al. ..... 347/43

* cited by examiner

*Primary Examiner*—Juanita Stephens
(74) *Attorney, Agent, or Firm*—Winston Hsu

(57) ABSTRACT

This present invention provides an ink jet printhead and method of delivering ink to the printhead. The printhead has a substrate, a nozzle layer, and a plurality of bubble generators. A plurality of first chambers and a plurality of second chambers are formed between the nozzle layer and the top of the substrate. A central ink flow channel and a periphery ink flow channel for delivering ink to the chambers are formed in the substrate. The characteristic of the present invention is positioning the central ink flow channel and the periphery ink flow channel together on the substrate so that the amount of the nozzles per unit area of the printhead is increased.

40 Claims, 20 Drawing Sheets

COMPACT PRINTHEAD AND METHOD OF DELIVERING INK TO THE PRINTHEAD

BACKGROUND OF INVENTION

1. Field of the Invention

The present invention relates to the field of ink jet printheads and associated ink delivering method, and more particularly, to a high-density ink jet printhead having a two-directional central ink flow channel and a one-directional periphery ink flow channel.

2. Description of the Related Art

Please refer to FIG. 1. FIG. 1 is a cross-sectional diagram of a prior art printhead 10. Structures similar to the printhead 10 are disclosed in U.S. Pat. Nos. 4,680,859 and 4,683,481 of Samuel A. Johnson and assigned to Hewlett-Packard Company. The printhead 10 comprises a central ink feed slot 12 formed at a center portion of a substrate 14. The ink feed slot 12 may be formed by sand blasting, laser cutting, or etching techniques. Heater resistors 16 are provided on both sides of the ink feed slot 12 for generating bubbles during an ink jet printing operation. An orifice plate 18 with a plurality of nozzles 22 formed therein is positioned on the substrate 14 and each of the nozzles 22 is positioned corresponding to one heater resistor 16. During an ink jet printing operation, ink will flow through the central ink feed slot 12 to chambers 24 between the orifice plate 18 and the substrate 14. The heater resistors 16 thereafter heat the ink flow into the chambers 24 to generate bubbles for pressurizing the ink, thereby forming an ink droplet 26.

Please refer to FIG. 2. FIG. 2 is a cross-sectional diagram of a prior art printhead 30. Similar structure is disclosed in U.S. Pat. No. 5,278,584 of Brian J. Keefe et al. and assigned to Hewlett-Packard Company. As shown in FIG. 2, the printhead 30 comprises a central ink slot 32 formed between a printhead cartridge 31 and a substrate 33. channels 34 are formed between the end of the central slot 32 and vaporization chambers 36. Each of the vaporization chambers 36 is provide with a thin film resistor 38 for generating a bubble. During an ink jet printing operation, ink from an ink reservoir (not shown) flows through the central slot 32 and split channels 34 to the vaporization chambers 36. When the thin film resistors 38 are energized, the ink within the vaporization chambers 36 is ejected, as illustrated by the emitted drops of ink 42.

Please refer to FIG. 3. FIG. 3 is another prior art printhead 50 disclosed in U.S. Pat. No. 6,010,208 of James Harold Powers et al. and assigned to Lexmark International Inc. Two rows of nozzles 54 are located one each side of a manifold 52 of the printhead 50. Ink flows through the central manifold 52 laterally to the chambers 56 corresponding to the nozzles 54.

Please refer to FIG. 4 and FIG. 5. FIG. 4 is a schematic diagram showing a prior art nozzle array of a color printhead 60. FIG. 5 is a schematic, cross-sectional view of an ink cartridge 70 having a printhead 60 of FIG. 4 mounted thereon. The ink cartridge 70 comprises three ink reservoirs 72 for storing ink of different colors such as yellow, magenta, and cyan. The printhead 60 includes a substrate with three ink slots 62 and a plurality of nozzles 64 arranged in six columns on an orifice plate 61. Each of the six columns of nozzles 64 is located on a side of the three ink slots 62 which are connected with associated ink reservoirs 72. Likewise, ink from the ink reservoirs 72 flows through the ink slots to the chambers and then splits into two flows in opposite directions. The heater resistors 66 then create ink bubbles to form drops of ink out of the nozzles 64. FIG. 6 is nozzle array of another prior art color printhead 80. Similarly, printhead 80 comprises six rows of nozzles 64 and three ink slots 62 (indicated by a dashed line). The difference between the printhead 60 and printhead 80 is the arrangement of the ink slots 62.

From above, ink from an ink reservoir is delivered either through a central ink feed slot or edge feed path (through an edge of a substrate). Unfortunately, the nozzles must be located near the ink slot, thus limiting the nozzle number of a printhead and resolution.

SUMMARY OF INVENTION

Accordingly, the primary objective of the present invention is to provide a printhead capable of delivering colors of ink simultaneously from a central path and an edge path.

Another objective of this invention is to provide an ink delivery method for increasing nozzle number in a unit area. Four or more columns of nozzles may be packed into a printhead having a smaller printhead surface, thereby improving its resolution.

Still another objective of this invention is to provide a printhead having a smaller size that is capable of printing three or more colors of ink.

Briefly, the printhead has a substrate, a nozzle layer, and a plurality of bubble generators. A plurality of first chambers and a plurality of second chambers are formed between the nozzle layer and the top of the substrate. A central ink flow channel and a periphery ink flow channel for delivering ink to the chambers are formed in the substrate. The characteristic of the present invention is that positioning the central ink flow channel and the periphery ink flow channel together on the substrate so that the amount of the nozzles per unit area of the printhead is increased.

DETAILED DESCRIPTION

Figure 1:
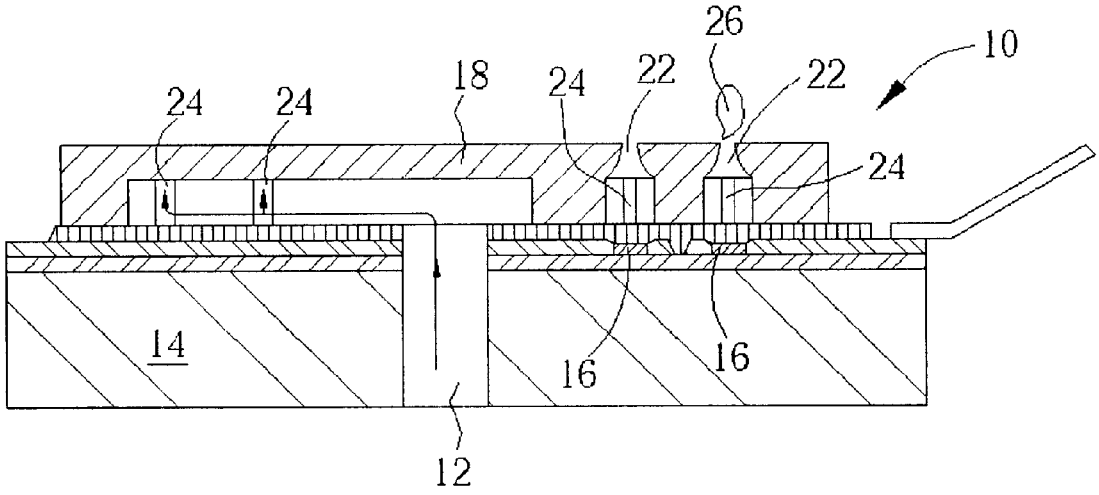
Fig. 1 Prior art
FIG. 1 is a cross-sectional diagram of a prior art printhead.
Figure 2:
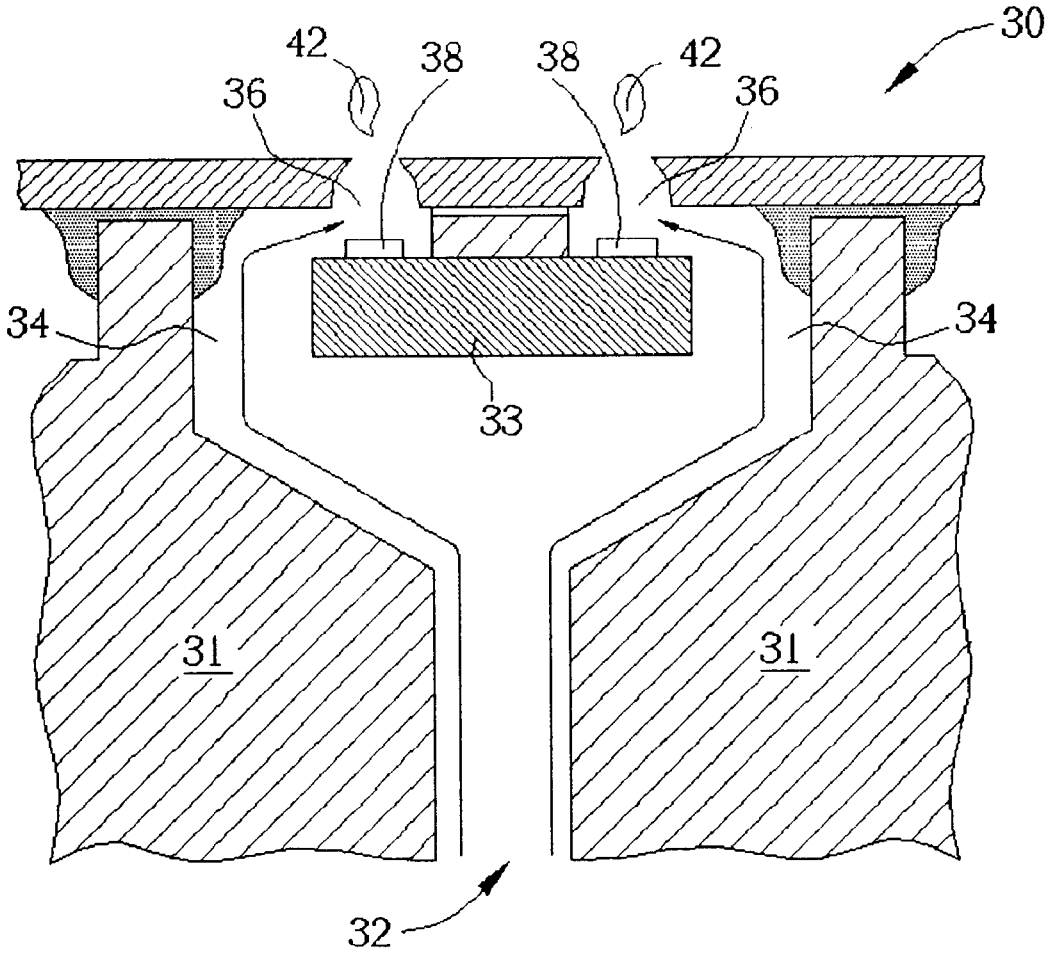
Fig. 2 Prior art
FIG. 2 is a cross-sectional diagram of another prior printhead.
Figure 3:
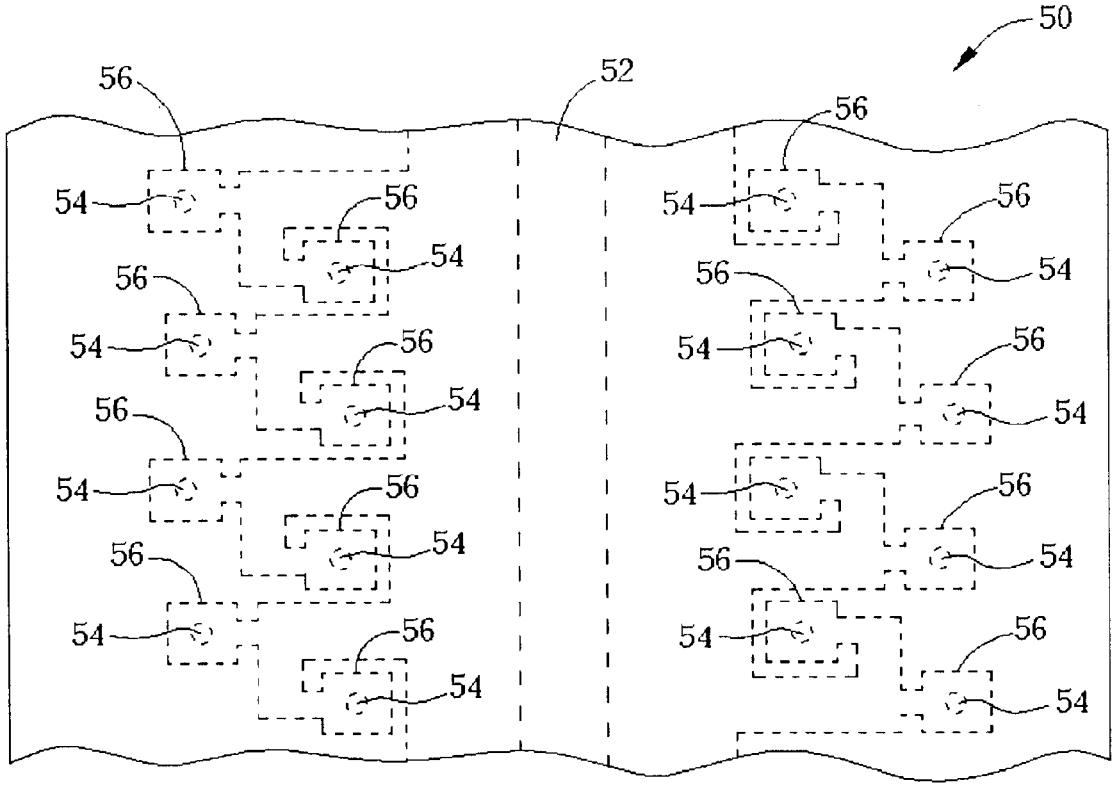
Fig. 3 Prior art
FIG. 3 is still another prior art printhead.
Figure 4:
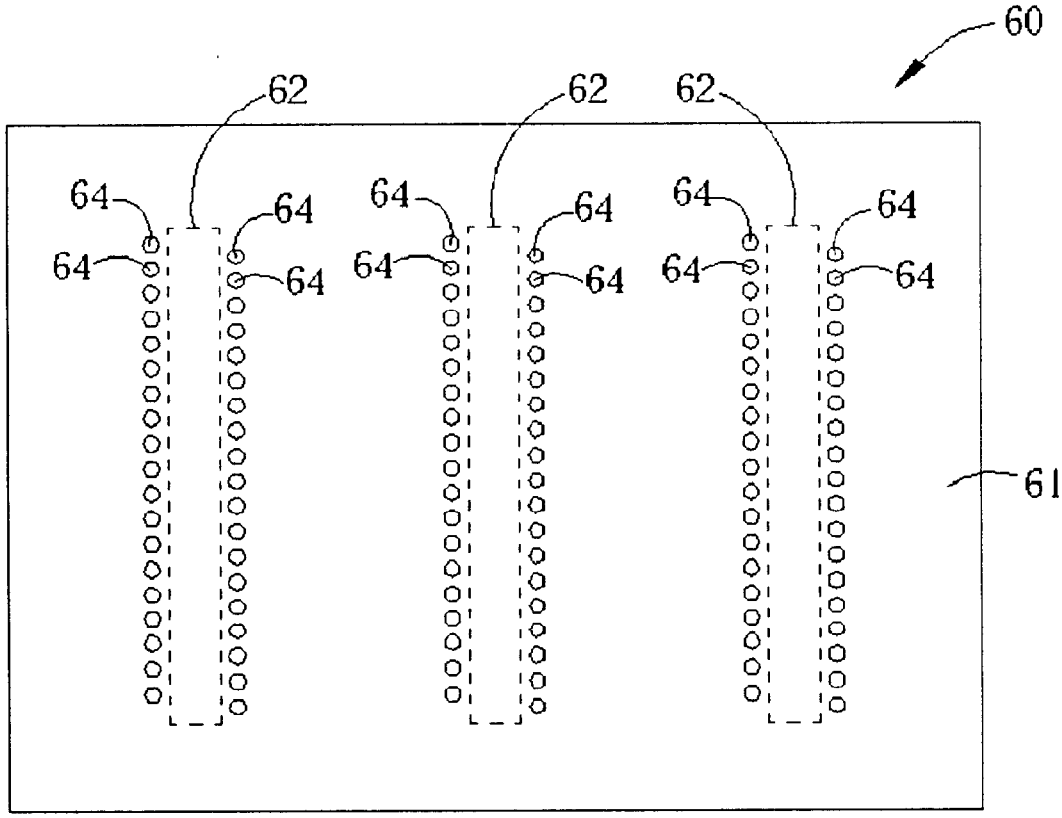
Fig. 4 Prior art
FIG. 4 is a schematic diagram showing a prior art nozzle array of a color printhead.
Figure 5:
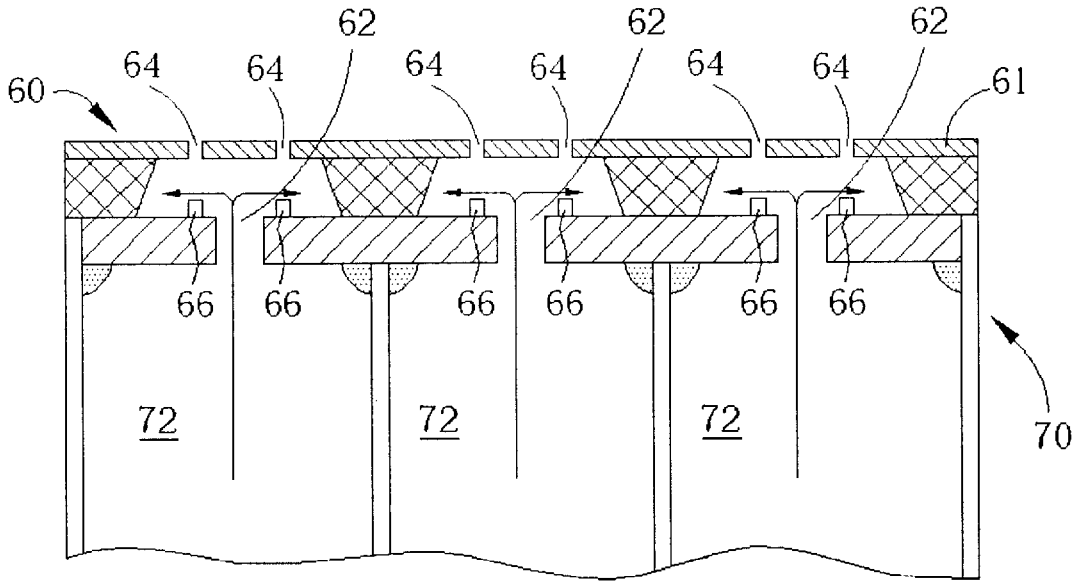
Fig. 5 Prior art
FIG. 5 is a schematic, cross-sectional view of an ink cartridge having a printhead of FIG. 4 mounted thereon.
Figure 6:
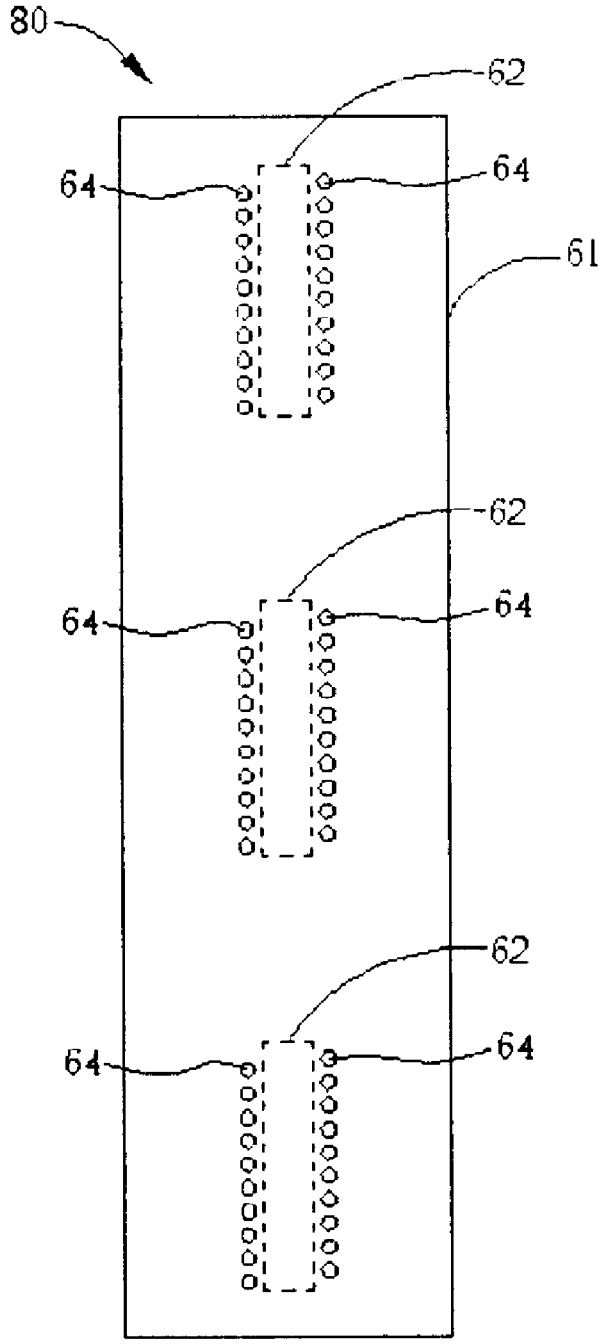
Fig. 6 Prior art
FIG. 6 is nozzle array of another prior art color printhead.
Figure 7:
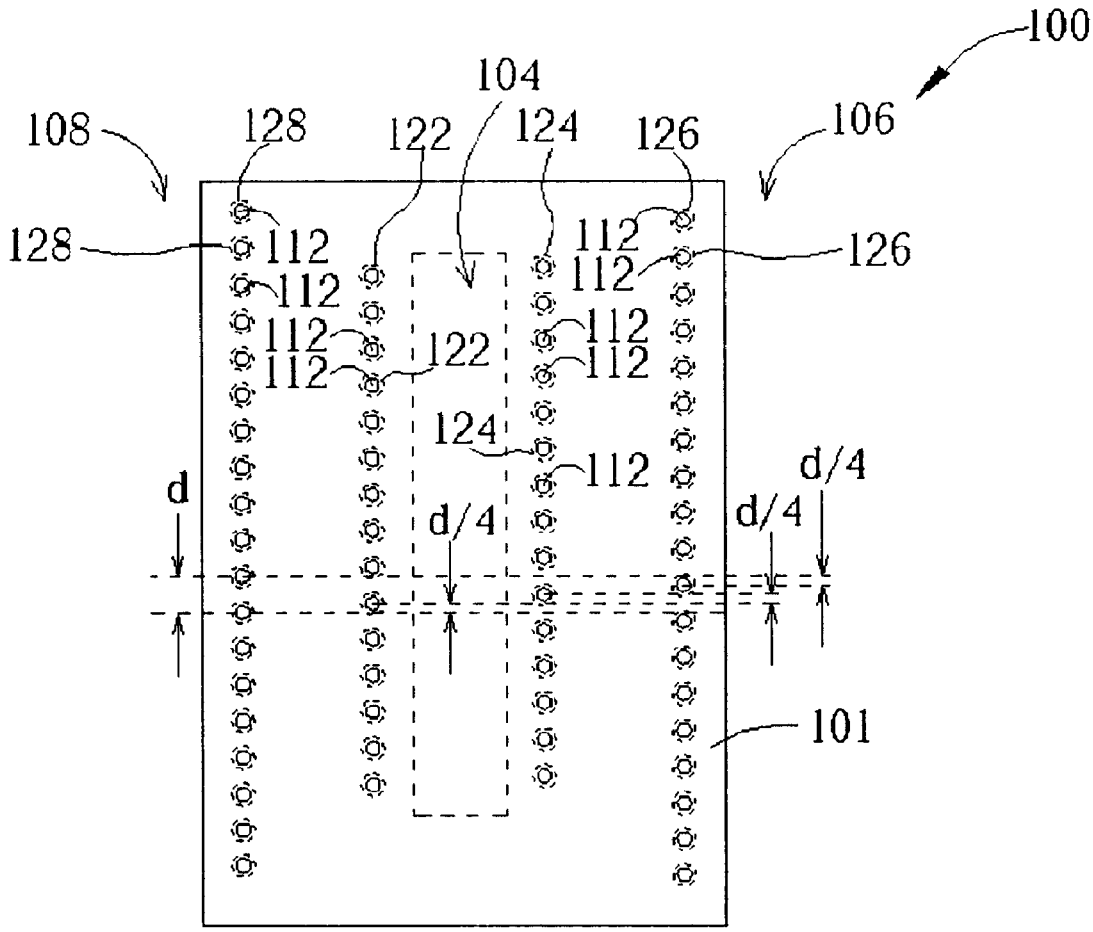
FIG. 7 is a schematic diagram showing the nozzle array of an ink jet printhead according to the first preferred embodiment of this invention.
Figure 8:
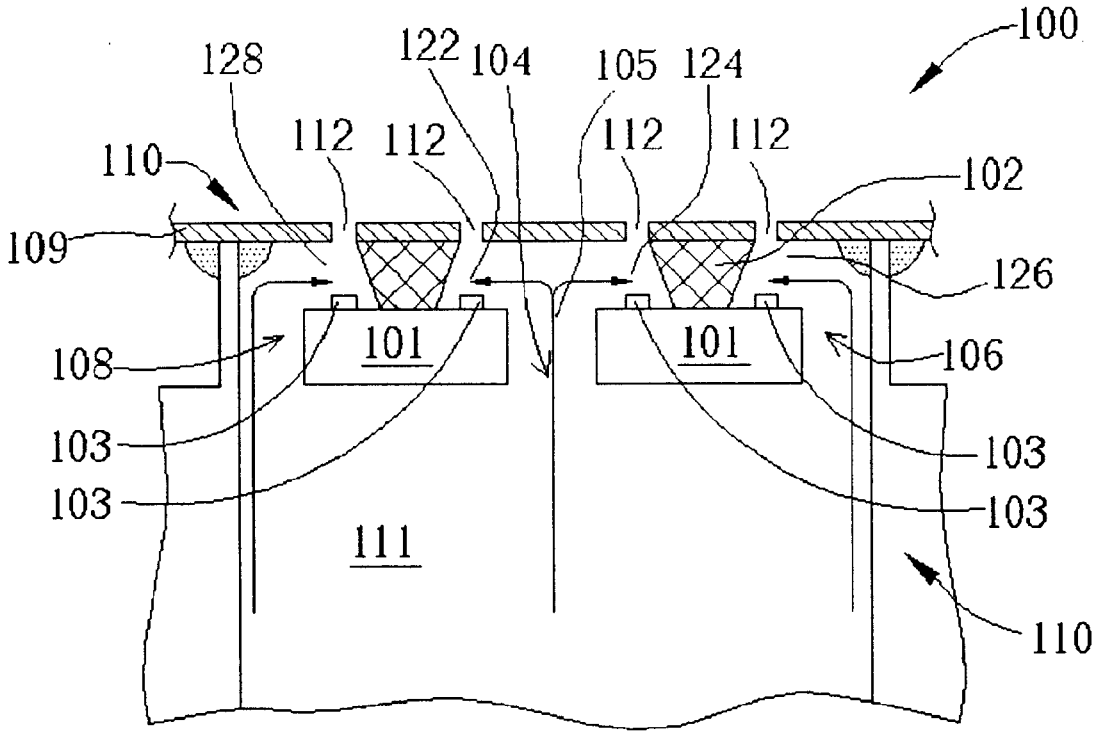
FIG. 8 is a schematic, cross-sectional view of an ink cartridge having a printhead of FIG. 7 mounted thereon.

Please refer to FIG. 7 and FIG. 8. FIG. 7 is a schematic diagram showing the nozzle array of an ink jet printhead 100 according to the first preferred embodiment of this invention. FIG. 8 is a schematic, cross-sectional view of an ink cartridge 110 having a printhead 100 of FIG. 7 mounted thereon. The printhead 100 comprises a substrate 101, a nozzle layer 102, and a plurality of bubble generators 103. The ink cartridge 110 comprises an ink reservoir 111 for storing ink. A tape automated bonding (TAB) circuit 109 is connected to the nozzle layer 102 and attached to the housing of the ink cartridge 110 with an adhesive layer (not shown). A first central ink flow channel 104 is formed within the substrate 101. A first periphery ink flow channel 106 and a second periphery ink flow channel 108 are formed at an edge of the substrate 101. The first central ink flow channel 104 has a first central opening 105 on an upper surface of the substrate 101. The nozzle layer 102 is positioned above the substrate. First chambers 122, second chambers 126, third chambers 124, and fourth chambers 128 are formed between the upper surface of the substrate 101 and the nozzle layer 102. The bubble generators 103 may be a heater resistor. The bubble generators are positioned below associated nozzles 112 for pressing drops of ink form out of the chambers 122, 124, 126, and 128.

The second periphery ink flow channel 108, fourth chambers 128, first chambers 122, central opening 105, third chambers 124, second chambers 126, and first periphery ink flow channel 106 are laid in sequence from left to right as indicated in FIG. 7 and FIG. 8. The first chambers 122 are located between the central opening 105 and the second periphery ink flow channel 108. The third chambers 124 are located between the central opening 105 and first periphery ink flow channel 106. During a jet printing operation, ink from the ink reservoir 111 flows through the first central ink flow channel 104 and the central opening 105 to the first chamber 122 and third chambers 124 (two-directional ink delivery). Meanwhile, ink flows through the first periphery ink flow channel 106 at one side of the edge of the substrate 101 to the second chambers 126 and also through the second periphery ink flow channel 108 at another side of the edge of the substrate 101 to the fourth chambers 128 (single-directional ink delivery).

In this embodiment, the first periphery ink flow channel 106 and second periphery ink flow channel 108 are confined by walls of the ink reservoir 111 and the edges of the substrate 101. In contrast to the prior art, such configuration enables the printhead 100 to provide additional third chambers 126 and fourth chambers 128 at periphery of the substrate 101 between the substrate 101 and the nozzle layer 102. This configuration increases resolution, namely, nozzle number within a unit area of the printhead 100. In another embodiment of this invention, only one of the first periphery ink flow channel 106 and second periphery ink flow channel 108 is provided. In either case, chambers corresponding to the omitted periphery ink flow channel are also omitted.

Figure 9:
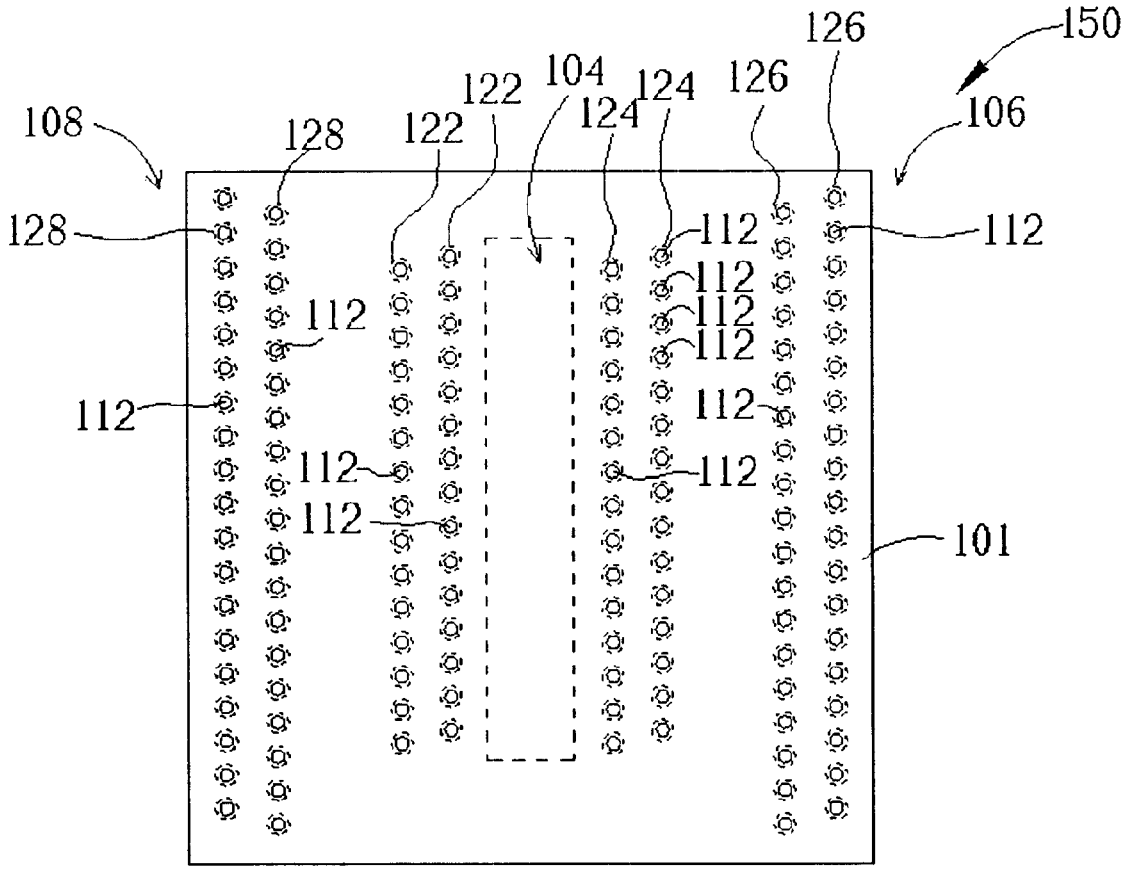
FIG. 9 is a schematic diagram showing the nozzle array of an ink jet printhead according to second preferred embodiment of this invention.
Figure 10:
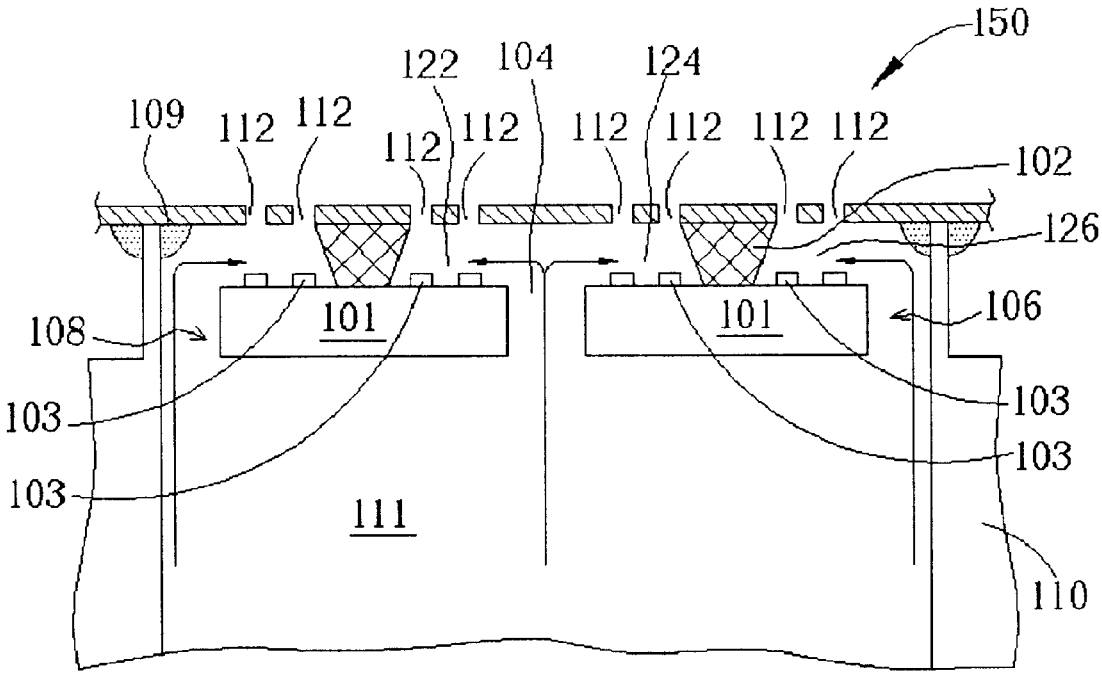
FIG. 10 is a schematic, cross-sectional view of an ink cartridge having a printhead of FIG. 9 mounted thereon.

Please refer to FIG. 9 and FIG. 10. FIG. 9 is a schematic diagram showing the nozzle array of an ink jet printhead 150 according to another preferred embodiment of this invention. FIG. 10 is a schematic, cross-sectional view of an ink cartridge 110 having a printhead 150 of FIG. 9 mounted thereon. The printhead 150 is very similar to the printhead 100 of FIG. 7 except that the chambers 122, 124, 126, and 128 and associated nozzles 112 are arranged in two columns on both sides of the central opening 105 as indicated in FIG. 9.

With reference to FIG. 7, ink stored in the ink reservoir 111 is a single color, for example, black color. Distance between adjacent two nozzles in each column (corresponding to chambers 122, 124, 126, and 128) is indicated as "d". This means that resolution for each column is equal, for example, 300 dpi (dots per inch) for each column. Most importantly, the nozzles in two adjacent columns are arranged alternately with an offset of, for example, d/4, as indicated with a dashed line in FIG. 7. In such way, during an ink jet printing operation, the printhead 100 may achieve a resolution of about four times the single column resolution (ex. 300 dpi), namely 1200 dpi. Likewise, in FIG. 9, the nozzles 112 in different columns are arranged alternatively with an offset of d/8. In this case, the resolution of the printhead 150 is about 2400 dpi with respect to a single column resolution of 300 dpi.

Figure 11:
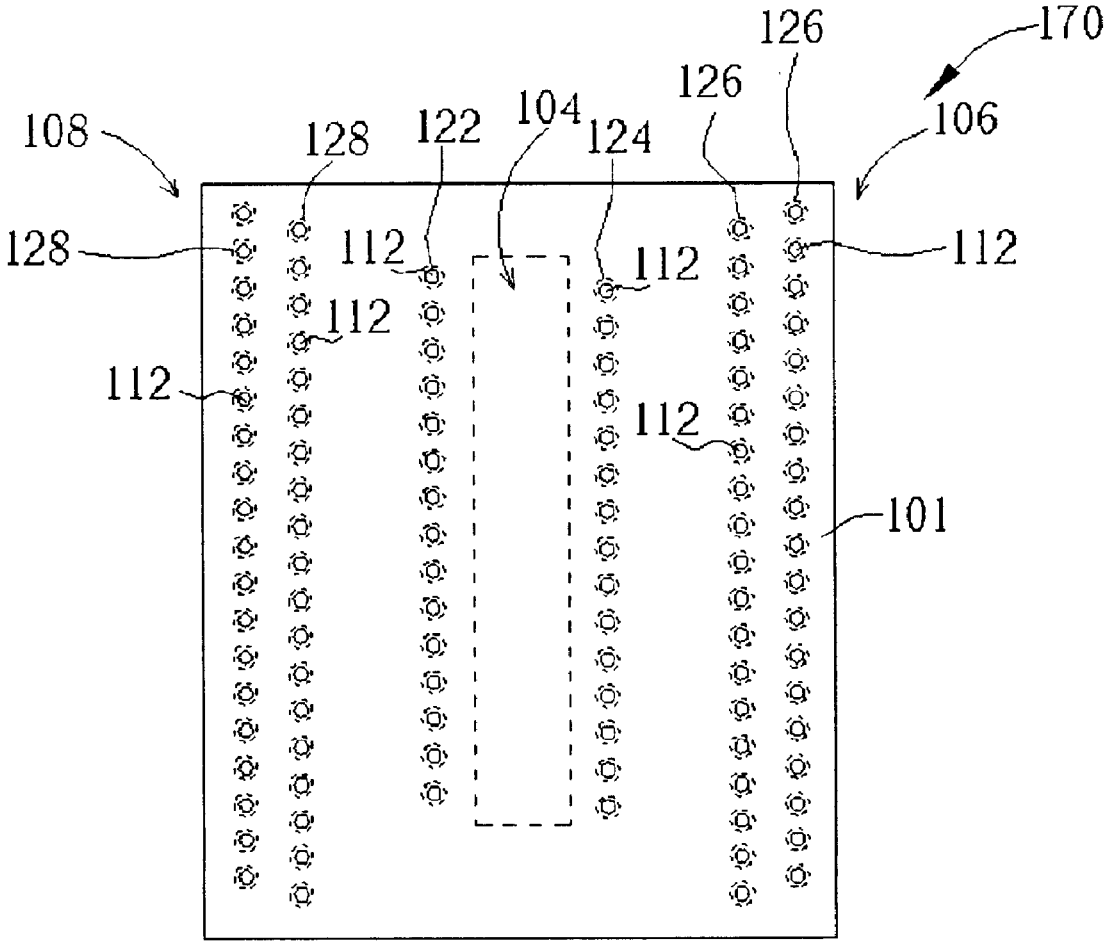
FIG. 11 is a plane view of a printhead according to the third preferred embodiment of this invention.
Figure 12:
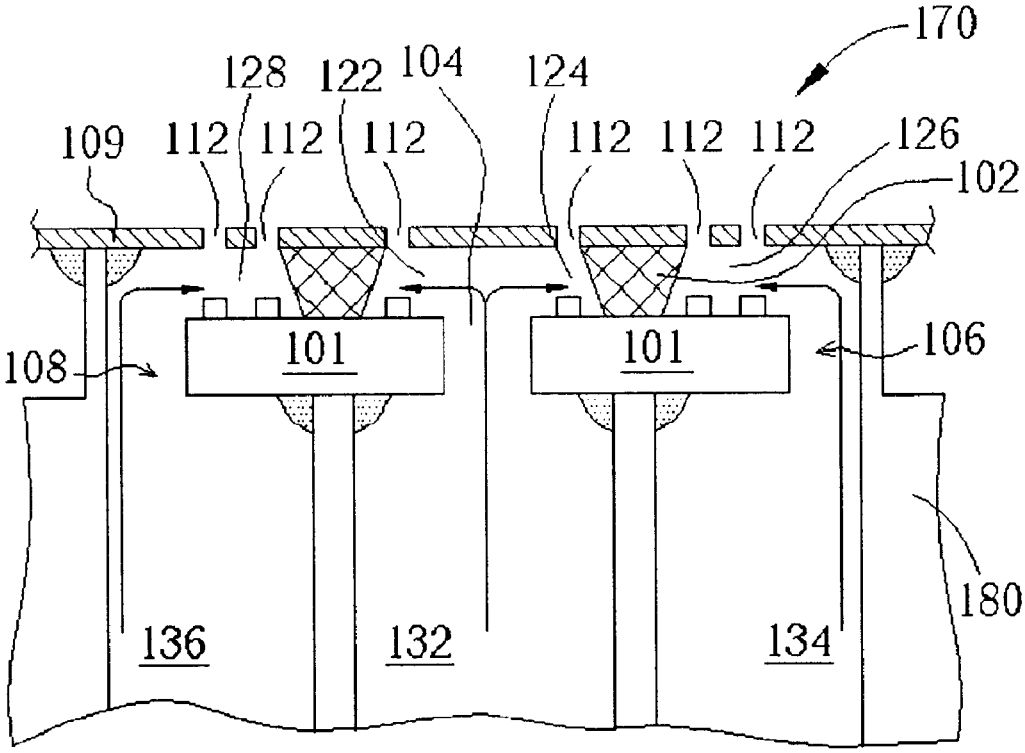
FIG. 12 is a cross sectional view of the printhead of FIG. 11 when mounted on a color ink cartridge.

Please refer to FIG. 11 and FIG. 12. FIG. 11 is a plane view of a printhead 170 according to the third preferred embodiment of this invention. FIG. 12 is a cross sectional view of the printhead 170 of FIG. 11 when mounted on a color ink cartridge 180. The color ink cartridge 180 comprises a first ink reservoir 132, a second ink reservoir 134, and a third ink reservoir 136 for storing three different colors of ink. These three different colors of ink may be, for example, magenta, yellow, and cyan, or may be light magenta, light yellow, and light cyan. The ink reservoirs 132, 134, and 136 are independent and not connected to each other. Likewise, the printhead 170 comprises a substrate 101 and a nozzle layer 102. There are a number of first chambers 122, second chambers 126, third chambers 124, and fourth chambers 128 provided between the substrate 101 and the nozzle layer 102. Similarly, a first central ink flow channel 104, a first periphery ink flow channel 106 and a second periphery ink flow channel 108 are formed in the substrate 101 for flowing ink stored in the first ink reservoir 132, second ink reservoir 134, and third ink reservoir 136, respectively. The first chambers 122 and the third chambers 124 are both arranged in a single column as shown in FIG. 11 and are connected with the first ink reservoir 132 through the first central opening 104. The second chambers 126 and the fourth chambers 128 are arranged in dual column formation, wherein the second chambers 126 are connected with the second ink reservoir 134 through the first periphery ink flow channel 106, and the fourth chambers 128 are connected with the third ink reservoir 136 through the second periphery ink flow channel 108.

In the third embodiment, since the first chambers 122 and the third chambers 124 provide the same color of ink, the arrays of the first chambers 122 and the third chambers 124 are arranged in an intersecting manner to improve resolution of the printhead 170. Further, both of the second chambers 126 and the fourth chambers 128 are arranged in an intersecting manner as shown in FIG. 11 in order to achieve the same resolution as the first chambers 122 and second chambers 124. By such design, the printhead 170 provides three colors of ink at the same time.

Figure 13:
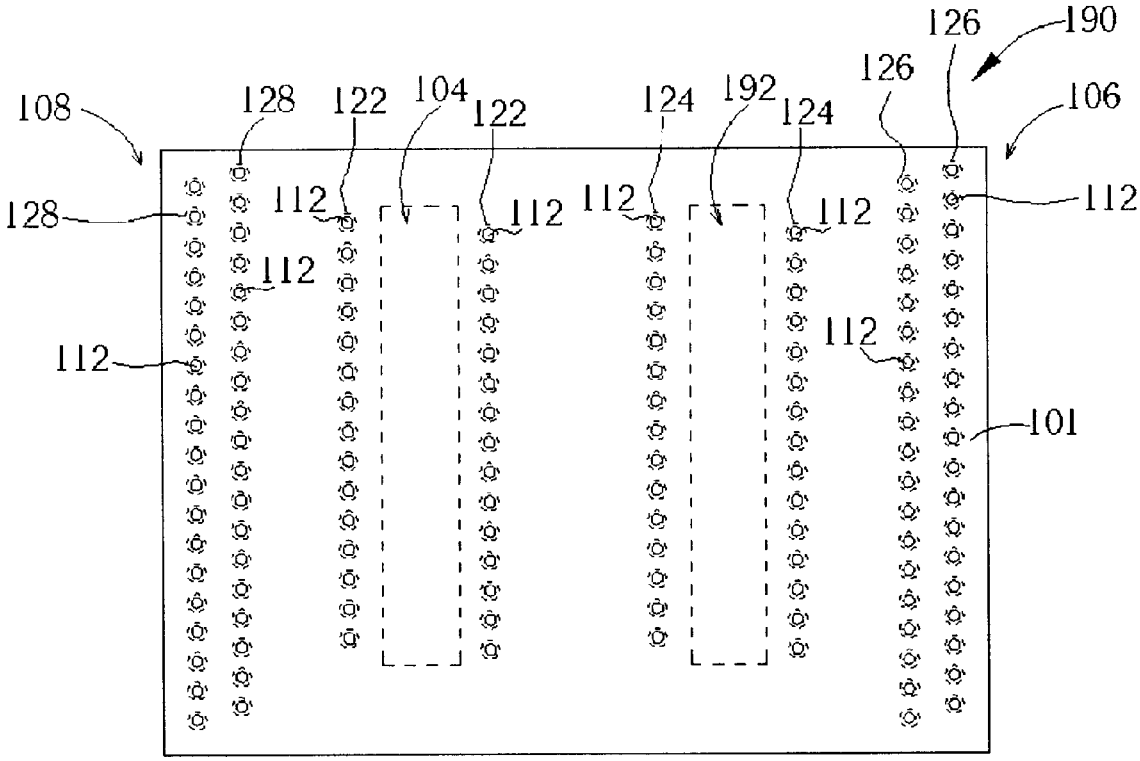
FIG. 13 is a plane view of a printhead according to the fourth embodiment of this invention.
Figure 14:
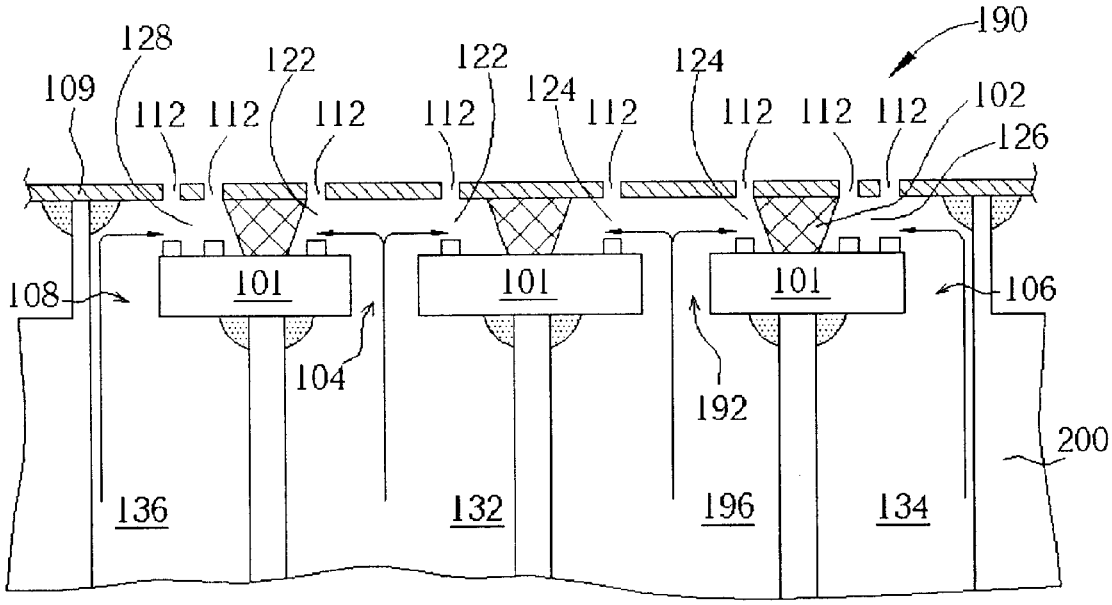
FIG. 14 is a cross sectional view of the printhead of FIG. 13 when mounted on a color ink cartridge.

Please refer to FIG. 13 and FIG. 14. FIG. 13 is a plane view of a printhead 190 according to the fourth embodiment of this invention. FIG. 14 is a cross sectional view of the printhead 190 of FIG. 13 when mounted on a color ink cartridge 200. The difference between the ink cartridge 200 and the ink cartridge 180 of FIG. 12 is that besides the first ink reservoir 132, second ink reservoir 134, and third ink reservoir 136, the color ink cartridge 200 further comprises a fourth ink reservoir 196 for storing another color of ink. The ink reservoirs 132, 134, 136, and 196 are independent and not connected to each other. In addition, besides the first central ink flow channel 104, the first periphery ink flow channel 106 and the second periphery ink flow channel 108, the substrate 101 further comprises a second central ink flow channel 192 located between the first central ink flow channel 104 and the first periphery ink flow channel 106. As shown in FIG. 13, a plurality of third chambers 124 arranged in two intersected columns are distributed on two sides of the second central ink flow channel 192 (indicated by a dashed line) between the nozzle layer 102 and the substrate 101. Likewise, the plurality of the first chambers 122 are distributed on two opposite sides of the first central ink flow channel 104. In this way, the printhead 190 is capable of providing four colors of ink. For example, black ink that is typically stored in another ink cartridge may be stored in the ink reservoir 196, while the other three ink reservoirs 132, 134, and 136 may store magenta, yellow, and cyan, or may store light magenta, light yellow, and light cyan, respectively.

Figure 15:
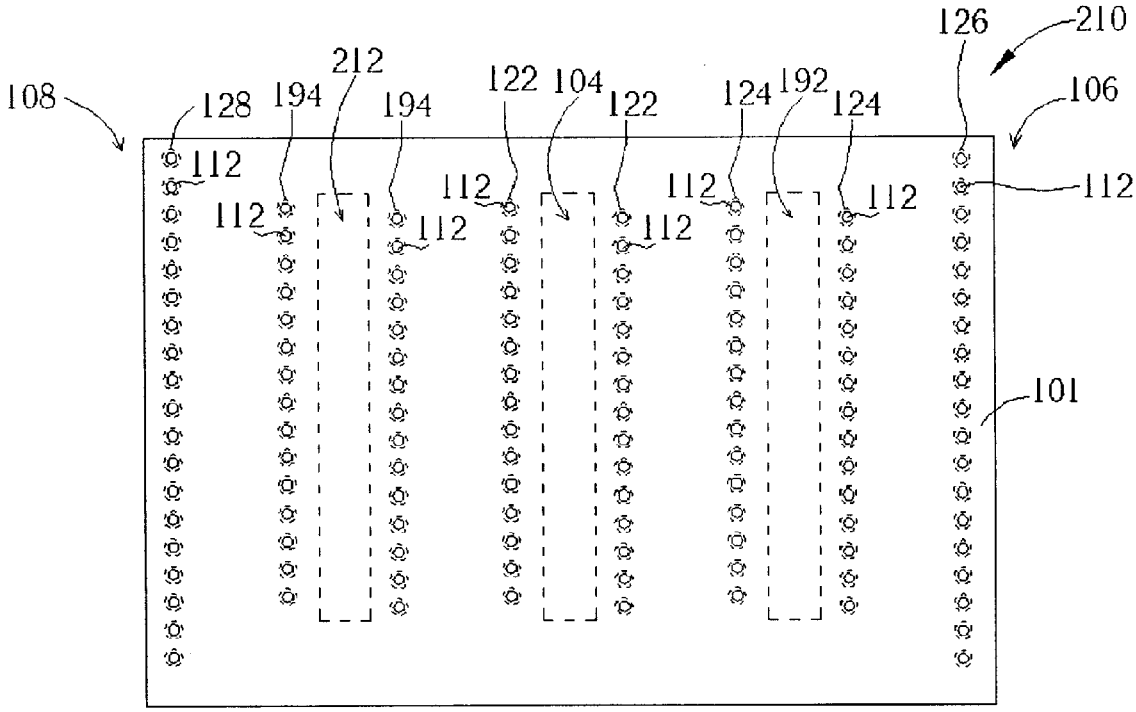
FIG. 15 is a plane view of a printhead according to the fifth embodiment of this invention.
Figure 16:
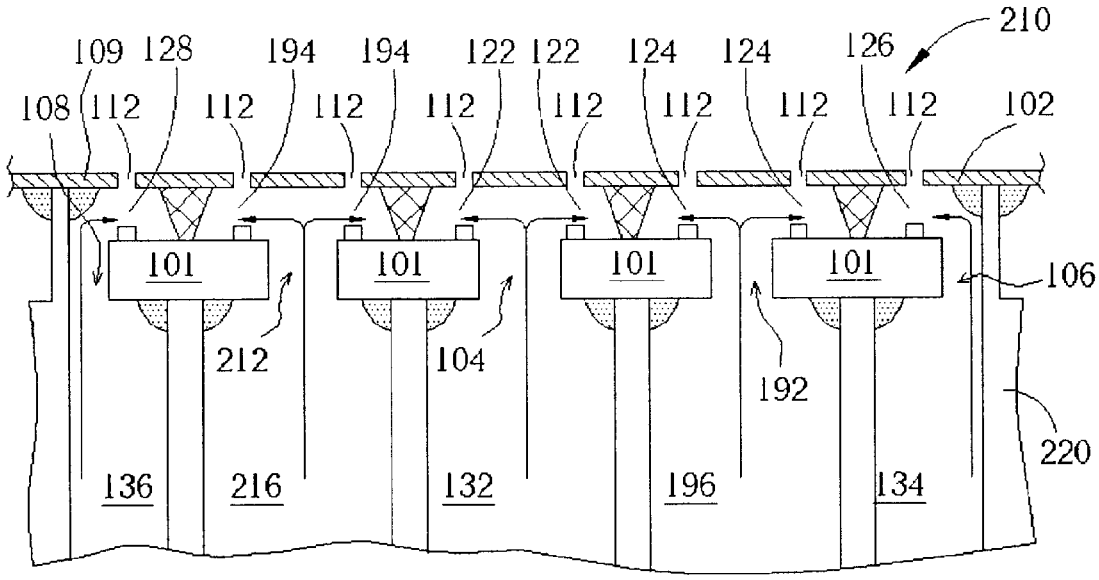
FIG. 16 is a cross sectional view of the printhead of FIG. 15 when mounted on a color ink cartridge.

Please refer to FIG. 15 and FIG. 16. FIG. 15 is a plane view of the printhead 210 according to the fifth embodiment of this invention. FIG. 16 is a cross sectional view of the printhead 210 of FIG. 15 when mounted on a color ink cartridge 220. The printhead 210 is capable of providing five colors of ink. The major difference between the printhead 190 and printhead 210 is that the printhead 210 comprises a third central ink flow channel 212 located between the first central ink flow channel 104 and the second periphery ink flow channel 108. A plurality of fifth chambers 194 arranged in two intersected columns are located on two opposite sides of the third central ink flow channel 212 between the nozzle layer 102 and the substrate 101. The first chambers 122 are distributed on two opposite sides of the first central ink flow channel 104. The third chambers 124 are distributed on two opposite sides of the second central ink flow channel 192. In addition to the first ink reservoir 132, second ink reservoir 134, third ink reservoir 136, and fourth ink reservoir 196, the color ink cartridge 220 further comprises a fifth ink reservoir 216 for storing a fifth color of Likewise, the five ink reservoirs 132, 134, 136, 196, and 216 are independent and are not connected to each other. In this embodiment, the first ink reservoir 132, the fourth ink reservoir 196, and the fifth ink reservoir 216 may store magenta ink, yellow ink, and cyan ink, respectively. The second ink reservoir 134 and the third ink reservoir 136 may store light magenta ink and light cyan ink, respectively. By this configuration, the color level of the printhead 210 may be improved.

Figure 17:
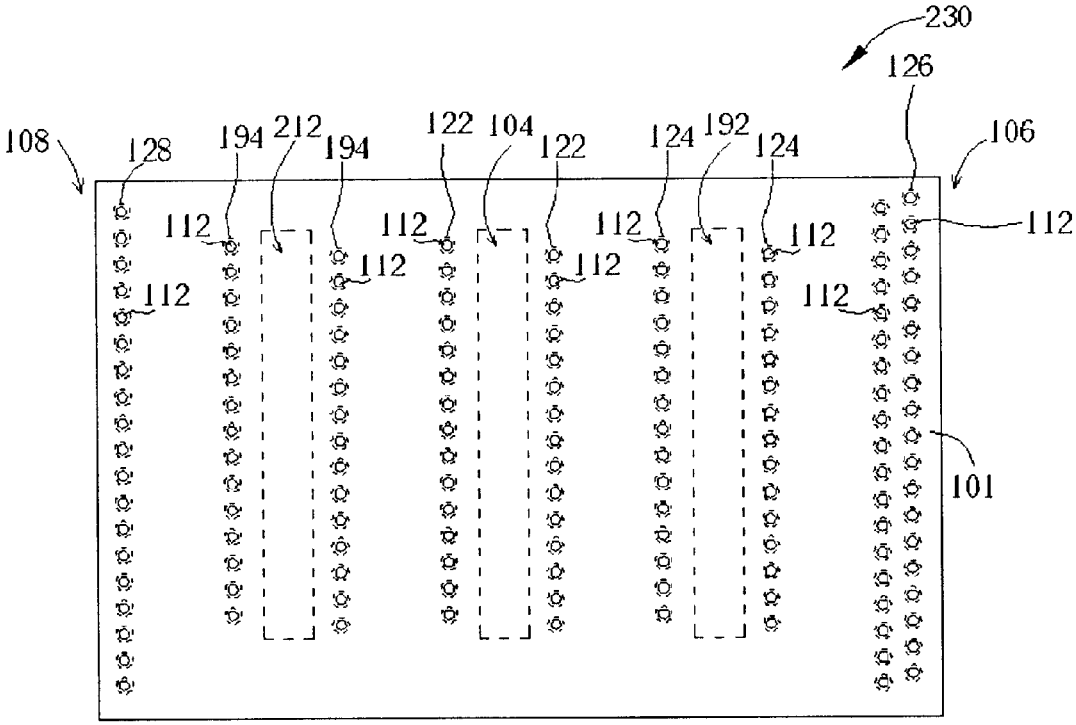
FIG. 17 is a plane view of a printhead according to the sixth embodiment of this invention.
Figure 18:
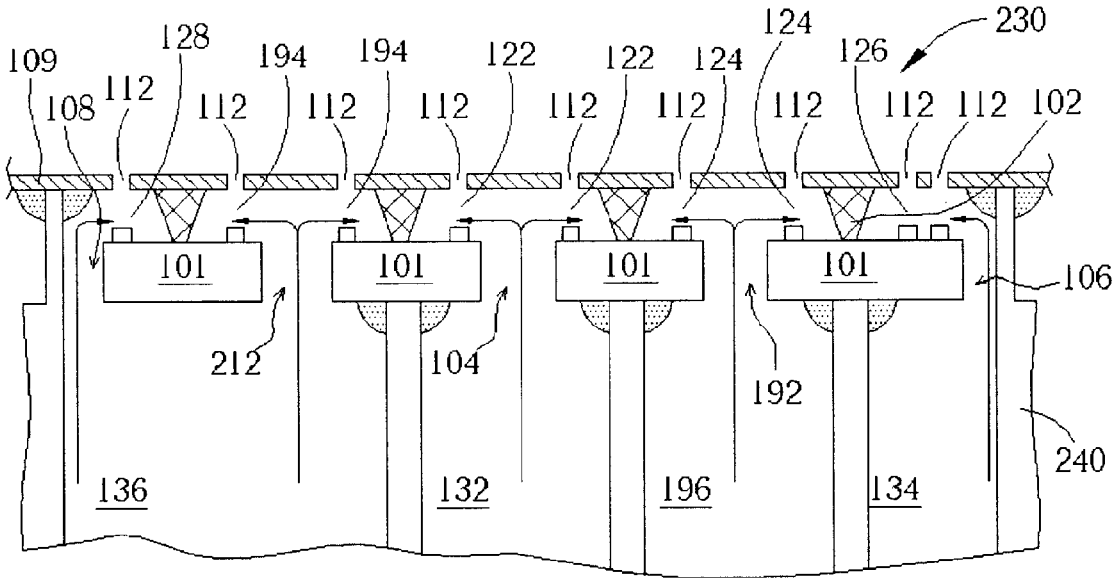
FIG. 18 is a cross sectional view of the printhead of FIG. 15 when mounted on a color ink cartridge.

Please refer to FIG. 17 and FIG. 18. FIG. 17 is a plane view of the printhead 230 according to the sixth embodiment of this invention. FIG. 18 is a cross sectional view of the printhead 230 of FIG. 15 when mounted on a color ink cartridge 240. The printhead 230 is capable of providing four colors of ink. The printhead 230 comprises a first central ink flow channel 104, a first periphery ink flow channel 106, a second periphery ink flow channel 108, a second central ink flow channel 192, and a third central ink flow channel 212. The ink cartridge 240 comprises four independent ink reservoirs 132, 134, 136, and 196, wherein the first reservoir 132, the second ink reservoir 134, and fourth ink reservoir 1 96 may store cyan ink, yellow ink, and magenta ink, respectively. The third ink reservoir 136 may store black ink. In this case, the black ink flows through the third central ink flow channel 212 to the fifth chambers 194 and through the second periphery ink flow channel 108 to the fourth chambers 128.

Figure 19:
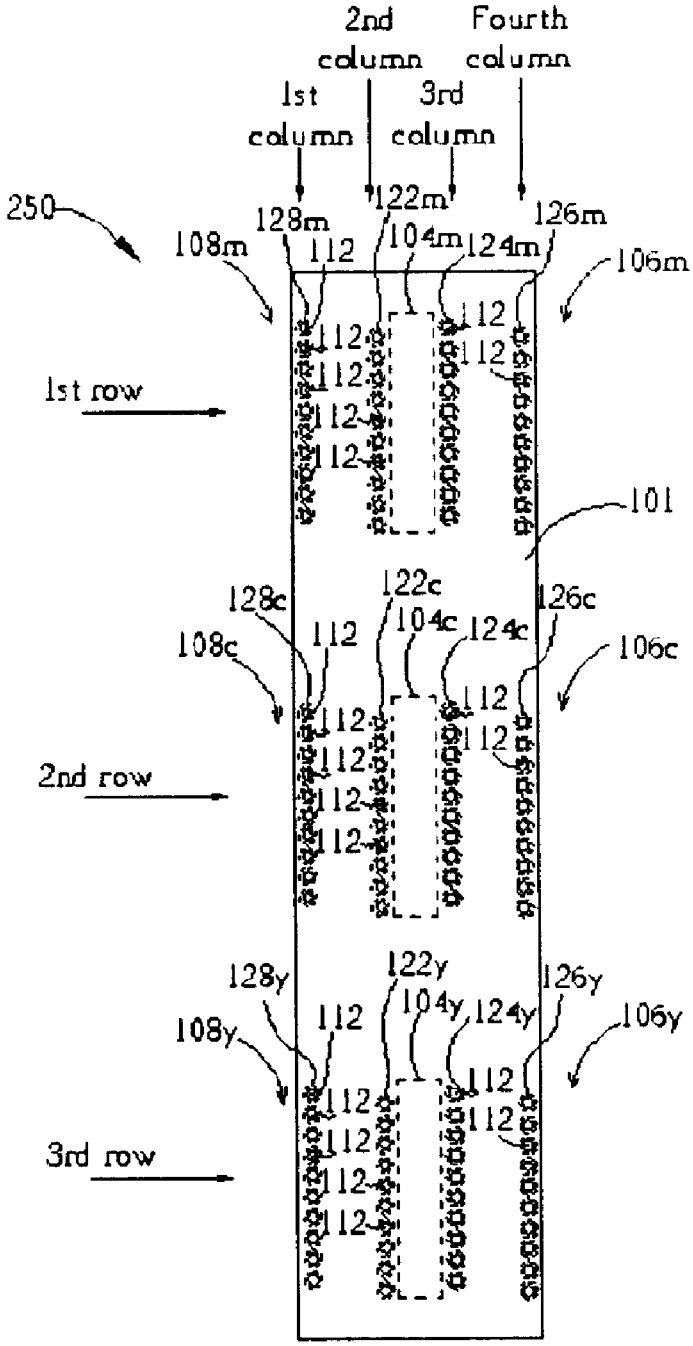
FIG. 19 is a plane view showing the seventh embodiment of this invention

Please refer to FIG. 19. FIG. 19 is a plane view showing an array of the nozzles of the printhead 250 according to the seventh embodiment of this invention. The printhead 250 provides three colors of ink during an ink jet printing operation. As shown in FIG. 19, the printhead 250 comprises a plurality of nozzles arranged in a 4 column×3 row configuration. Three central ink flow channels 104*m*, 104*c*, 104*y* (indicated by a dashed line), three first periphery ink flow channels 106*m*, 106*c*, 106*y*, and three second periphery ink flow channels 108*m*, 108*c*, 108*y* are provided. The central ink flow channels 104*m*, 104*c*, 104*y* are used to deliver ink to the second column of nozzles and third column of nozzles 112. The first periphery ink flow channels 106*m*, 106*c*, 106*y* are used to deliver ink to nozzles 112 in fourth column. The second periphery ink flow channels 108*m*, 108*c*, 108*y* are used to deliver ink to nozzles 112 in first column. The nozzles 112 in first column are connected with a first ink reservoir (not shown). The nozzles 112 in the second column are connected with a second ink reservoir. The nozzles 112 in the third column are connected with a third ink reservoir. The three ink reservoirs store different colors of ink and are independent.

Figure 20:
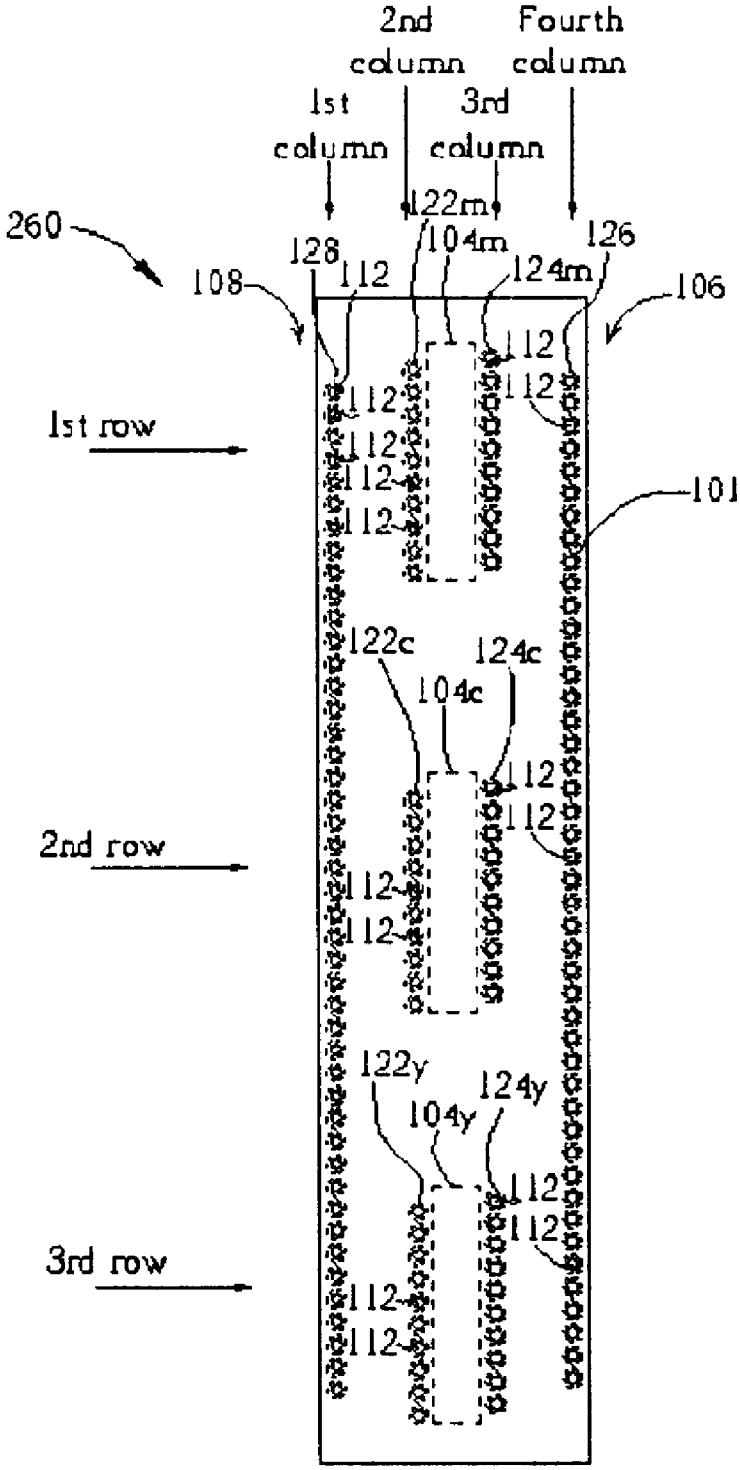
FIG. 20 is a plane view showing the eighth embodiment of this invention.

Please refer to FIG. 20. FIG. 20 is a plane view showing an array of the printhead 260 according to the eighth embodiment of this invention. The printhead 260 is capable of providing five colors of ink during an ink jet printing operation. As shown in FIG. 20, the printhead 260 comprises a plurality of nozzles 112 arranged in a 4 column×3 row configuration. Three central ink flow channels 104*m*, 104*c*, 104*y* (indicated by a dashed line), one first periphery ink flow channel 106, and one second periphery ink flow channel 108 are provided. The central ink flow channels 104*m*, 104*c*, 104*y* are used to deliver ink to the second column of nozzles and third column of nozzles 112. The first periphery ink flow channel 106 is used to deliver ink to nozzles 112 in fourth column. The second periphery ink flow channel 108 is used to deliver ink to nozzles 112 in first column. The nozzles 112 in first column are connected with a first ink reservoir (not shown). The nozzles 112 in the fourth column are connected with a second ink reservoir. The nozzles 112 in the second and third columns of the first row are connected with a third ink reservoir. The nozzles 112 in the second and third columns of the second row are connected with a fourth ink reservoir. The nozzles 112 in the second and third columns of the third row are connected with a fifth ink reservoir. Likewise, the five ink reservoirs store different colors of ink and are independent.

In contrast to the prior art, the printhead of this invention utilizes both a central ink delivery path (through central ink flow channel) and an edge ink delivery path (through the periphery ink flow channel). Further, since four or more columns of nozzles may be packed into a printhead having a smaller printhead surface, nozzle number within a unit area is significantly increased, thereby improving its resolution. Alternately, this invention may provide a printhead having a smaller size that is capable of printing three or more colors of ink.

Those skilled in the art will readily observe that numerous modification and alterations of the device may be made while retaining the teachings of the invention. For example, the printhead of this invention may be suitable for fuel injection systems, cell sorting, drug delivery systems, direct print lithography, and micro jet propulsion systems. Accordingly, the above disclosure should be construed as limited only by the metes and bounds of the appended claims.

What is claimed is:

1. An ink jet printhead comprising:

a substrate, wherein a first central ink flow channel is formed within the substrate, and a first periphery ink flow channel is formed at an edge of the substrate, the first central ink flow channel having a first central opening on an upper surface of the substrate, a second central ink flow channel and a second central opening connected thereto being formed within the substrate; and a nozzle layer positioned above the substrate, wherein a plurality of first chambers, a plurality of second chambers, and a plurality of fifth chambers are formed between the upper surface of the substrate and the nozzle layer, the first chambers are positioned adjacent to the first central ink flow channel, the second chambers are positioned adjacent to the first periphery ink flow channel, and the fifth chambers are positioned adjacent to the second central ink flow channel and the second central opening;

wherein ink flows through the first central ink flow channel and the first central opening to be delivered to the first chambers, and ink flows in a single direction through the first periphery ink flow channel to be delivered to the second chambers.

2. The printhead of claim 1 further comprising a plurality of bubble generators and a plurality of nozzles, each of the bubble generators corresponding to one of the chambers and is adjacent to a corresponding nozzle, each of the bubble generators is used for generating bubbles within the corresponding chamber so as to push ink within the corresponding chamber out of the corresponding nozzle.

3. The printhead of claim 1 wherein a plurality of third chambers are formed between the upper surface of the substrate and the nozzle layer, and the first central ink flow channel is positioned between the plurality of first chambers and the plurality of third chambers, wherein ink flows through the first central ink flow channel and the first central opening to be delivered to the third chambers.

4. The printhead of claim 1 wherein a second periphery ink flow channel is formed at the edge of the substrate, and a plurality of fourth chambers is formed between the upper surface of the substrate and the nozzle layer, the fourth chambers are in fluid communication with the second periphery ink flow channel, and ink flows in a single direction through the second periphery ink flow channel to be delivered to the fourth chambers.

5. The printhead of claim 4 wherein the first periphery ink flow channel is positioned at one elongate side of the edge of the substrate, and the second periphery ink flow channel is positioned at opposite elongate side of the edge of the substrate.

6. The printhead of claim 4 wherein the first central ink flow channel, the first periphery ink flow channel, and the second periphery ink flow channel are in fluid communication with an ink reservoir, ink stored in the ink reservoir flows through the first central ink flow channel to be delivered to the first chambers, flows through the first periphery ink flow channel to be delivered to the second chambers, and flows through the second periphery ink flow channel to be delivered to the fourth chambers.

7. The printhead of claim 4 wherein the first central ink flow channel is in fluid communication with a first ink reservoir, the first periphery ink flow channel is in fluid communication with a second ink reservoir, and the second periphery ink flow channel is in fluid communication with a third ink reservoir, the first ink reservoir, the second ink reservoir, and the third ink reservoir are not in fluid communication with each other, ink stored in the first ink reservoir flows through the first central ink flow channel to be delivered to the first chambers, ink stored in the second ink reservoir flows through the first periphery ink flow channel to be delivered to the second chambers, and ink stored in the third ink reservoir flows through the second periphery ink flow channel to be delivered to the fourth chambers.

8. The printhead of claim 7 wherein the first ink reservoir, the second ink reservoir, and the third ink reservoir are used for storing three different colors of ink.

9. The printhead of claim 1 wherein a third central ink flow channel and a third central opening connected thereto are formed within the substrate, a plurality of sixth chambers is formed between the upper surface of the substrate and the nozzle layer, and the sixth chambers are positioned adjacent to the third central ink flow channel and the third central opening.

10. The printhead of claim 9 wherein the first central ink flow channel, the second central ink flow channel, and the third central ink flow channel are arranged in row substantially perpendicular to the array of the nozzles.

11. The printhead of claim 9 wherein the first central ink flow channel, the second central ink flow channel, and the third central ink flow channel are arranged in column substantially parallel to the array of the nozzles.

12. The printhead of claim 11 wherein a second periphery ink flow channel is formed at the edge of the substrate, and a plurality of fourth chambers is formed between the upper surface of the substrate and the nozzle layer, the fourth chambers are in fluid communication with the second periphery ink flow channel, and ink flows in a single direction through the second periphery ink flow channel to be delivered to the fourth chambers.

13. The printhead of claim 12 wherein the second chambers and the fourth chambers are arranged in column along the elongate side of the substrate.

14. The printhead of claim 13 wherein the second chambers and the fourth chambers are divided into three parts and arranged in column horizontally corresponding to the first chambers, the fifth chambers, and the sixth chambers, respectively.

15. The printhead of claim 14 wherein a first part of the second chambers and a first part of the fourth chambers are arranged horizontally corresponding to the first chambers, the first part of the second chambers, the first part of the fourth chambers, and the first chambers are in fluid communication with a first ink reservoir, a second part of the second chambers and a second part of the fourth chambers are arranged horizontally corresponding to the fifth chambers, the second part of the second chambers, the second part of the fourth chambers, and the fifth chambers are in fluid communication with a second ink reservoir, a third part of the second chambers and a third part of the fourth chambers are arranged horizontally corresponding to the sixth chambers, the third part of the second chambers, the third part of the fourth chambers, and the sixth chambers are in fluid communication with a third ink reservoir, and the first ink reservoir, the second ink reservoir, and the third ink reservoir are not in fluid communication with each other.

16. The printhead of claim 15 wherein the first ink reservoir, the second ink reservoir, and the third ink reservoir are used for storing three different colors of ink.

17. The printhead of claim 12 wherein the first central ink flow channel is in fluid communication with a first ink reservoir, the first periphery ink flow channel is in fluid communication with a second ink reservoir, and the second periphery ink flow channel is in fluid communication with a third ink reservoir, the first ink reservoir, the second ink reservoir, and the third ink reservoir are not in fluid communication with each other, ink stored in the first ink reservoir flows through the first central ink flow channel to be delivered to the first chambers, ink stored in the second ink reservoir flows through the first periphery ink flow channel to be delivered to the second chambers, and ink stored in the third ink reservoir flows through the second periphery ink flow channel to be delivered to the fourth chambers.

18. The printhead of claim 17 wherein the first ink reservoir, the second ink reservoir, and the third ink reservoir are used for storing three different colors of ink.

19. The printhead of claim 17 wherein the second central ink flow channel is in fluid communication with a fourth ink reservoir, and the third central ink flow channel is in fluid communication with a fifth ink reservoir, the first ink reservoir, the second ink reservoir, the third ink reservoir, the fourth ink reservoir, and the fifth ink reservoir are not in fluid communication with each other, ink stored in the fourth ink reservoir flows through the second central ink flow channel to be delivered to the third chambers, and ink stored in the fifth ink reservoir flows through the third central ink flow channel to be delivered to the fifth chambers.

20. The printhead of claim 19 wherein the first ink reservoir, the second ink reservoir, the third ink reservoir, the fourth ink reservoir, and the fifth ink reservoir are used for storing five different colors of ink.

21. The printhead of claim 1 wherein the first central ink flow channel and the first periphery ink flow channel are in fluid communication with an ink reservoir, ink stored in the ink reservoir flows through the first central ink flow channel to be delivered to the first chambers, and flows through the first periphery ink flow channel to be delivered to the second chambers.

22. The printhead of claim 1 wherein the first central ink flow channel is in fluid communication with a first ink reservoir, and the first periphery ink flow channel is in fluid communication with a second ink reservoir, the first ink reservoir and the second ink reservoir are not in fluid communication with each other, ink stored in the first ink reservoir flows through the first central ink flow channel to be delivered to the first chambers, and ink stored in the second ink reservoir flows through the first periphery ink flow channel to be delivered to the second chambers.

23. The printhead of claim 1 wherein the plurality of first chambers or the plurality of second chambers are arranged in a plurality of rows.

24. The printhead of claim 1 wherein the plurality of first chambers and the plurality of second chambers are arranged in a plurality of rows.

25. A method for delivering ink comprising:

providing an ink container, the ink container having a first reservoir for storing ink; and providing an ink jet printhead and combining the printhead with the ink container, the printhead comprising:

a substrate, wherein a first central ink flow channel is formed within the substrate, and a first periphery ink flow channel is formed at an edge of the substrate, the first central ink flow channel having a first central opening on an upper surface of the substrate, a second central ink flow channel being formed within the substrate; and a nozzle layer positioned above the substrate, wherein a plurality of first chambers, a plurality of second chambers, and a plurality of fifth chambers are formed between the upper surface of the substrate and the nozzle layer, the first chambers are positioned adjacent to the first central ink flow channel, the second chambers are positioned adjacent to the first periphery ink flow channel, and the fifth chambers are positioned adjacent to the second central ink flow channel;

wherein ink flows through the first central ink flow channel and the first central opening to be delivered to the first chambers, and ink flows in a single direction through the first periphery ink flow channel to be delivered to the second chambers.

26. The method of claim 25 wherein the printhead further comprises a plurality of bubble generators and a plurality of nozzles, each of the bubble generators corresponding to one of the chambers and is adjacent to a corresponding nozzle, each of the bubble generators is used for generating bubbles within the corresponding chamber so as to push ink within the corresponding chamber out of the corresponding nozzle.

27. The method of claim 25 wherein a plurality of third chambers are formed between the upper surface of the substrate and the nozzle layer, and the first central ink flow channel is positioned between the first chambers and the third chambers, wherein ink flows through the first central ink flow channel and the first central opening to be delivered to the third chambers.

28. The method of claim 25 wherein a second periphery ink flow channel is formed at the edge of the substrate, and a plurality of fourth chambers is formed between the upper surface of the substrate and the nozzle layer, the fourth chambers are in fluid communication with the second periphery ink flow channel, and ink flows in a single direction through the second periphery ink flow channel to be delivered to the fourth chambers.

29. The method of claim 28 wherein the first periphery ink flow channel is positioned at one elongate side of the edge of the substrate, and the second periphery ink flow channel is positioned at opposite elongate side of the edge of the substrate.

30. The method of claim 28 wherein the first central ink flow channel, the first periphery ink flow channel, and the second periphery ink flow channel are in fluid communication with the first reservoir, ink stored in the first reservoir flows through the first central ink flow channel to be delivered to the first chambers, flows through the first periphery ink flow channel to be delivered to the second chambers, and flows through the second periphery ink flow channel to be delivered to the fourth chambers.

31. The method of claim 28 wherein the ink container further comprises a second ink reservoir and a third ink reservoir, the first ink reservoir, the second ink reservoir, and the third ink reservoir are not in fluid communication with each other, ink stored in the first ink reservoir flows through the first central ink flow channel to be delivered to the first chambers, ink stored in the second ink reservoir flows through the first periphery ink flow channel to be delivered to the second chambers, and ink stored in the third ink reservoir flows through the second periphery ink flow channel to be delivered to the fourth chambers.

32. The method of claim 31 wherein the first ink reservoir, the second ink reservoir, and the third ink reservoir are used for storing three different colors of ink.

33. The method of claim 25 wherein a third central ink flow channel is formed within the substrate, a plurality of sixth chambers is formed between the upper surface of the substrate and the nozzle layer, and the sixth chambers are positioned adjacent to the third central ink flow channel.

34. The method of claim 33 wherein the first central ink flow channel, the second central ink flow channel, and the third central ink flow channel are arranged in row substantially perpendicular to the array of the nozzles.

35. The method of claim 33 wherein the first central ink flow channel, the second central ink flow channel, and the third central ink flow channel are arranged in column substantially parallel to the array of the nozzles.

36. The method of claim 35 wherein a second periphery ink flow channel is formed at the edge of the substrate, and a plurality of fourth chambers is formed between the upper surface of the substrate and the nozzle layer, the fourth chambers are in fluid communication with the second periphery ink flow channel, and ink flows in a single direction through the second periphery ink flow channel to be delivered to the fourth chambers.

37. The method of claim 36 wherein the second chambers and the fourth chambers are arranged in column along the elongate side of the substrate.

38. The method of claim 37 wherein the second chambers and the fourth chambers are divided into three parts and arranged in column horizontally corresponding to the first chambers, the fifth chambers, and the sixth chambers, respectively.

39. The method of claim 25 wherein the first central ink flow channel and the first periphery ink flow channel are in fluid communication with the first ink reservoir, ink stored in the first ink reservoir flows through the first central ink flow channel to be delivered to the first chambers, and flows through the first periphery ink flow channel to be delivered to the second chambers.

40. The method of claim 25 wherein the ink container further comprises a second ink reservoir, the first central ink flow channel is in fluid communication with the first ink reservoir, and the first periphery ink flow channel is in fluid communication with the second ink reservoir, the first ink reservoir and the second ink reservoir are not in fluid communication with each other, ink stored in the first ink reservoir flows through the first central ink flow reservoir to be delivered to the first chambers, and ink stored in the second ink reservoir flows through the first periphery ink flow channel to be delivered to the second chambers.

* * * * *